United States Patent [19]

Hutchins

[11] Patent Number: 4,733,480

[45] Date of Patent: Mar. 29, 1988

[54] DRYER FOR GAS MASKS AND THE LIKE

[76] Inventor: Toby Hutchins, 229 Brown Rd., Pisgah Forest, N.C. 28769

[21] Appl. No.: 23,715

[22] Filed: Mar. 9, 1987

[51] Int. Cl.[4] ..... F26B 9/06

[52] U.S. Cl. ..... 34/104; 34/202; 34/233

[58] Field of Search ..... 34/104, 225, 233, 202, 34/210

[56] References Cited

U.S. PATENT DOCUMENTS

| | | | |
|---|---|---|---|
| 1,688,793 | 10/1928 | Schrenkeisen | 34/104 |
| 1,731,272 | 10/1929 | Schrenkeisen | 34/104 |
| 2,340,206 | 1/1944 | Richards | 34/104 |
| 4,158,262 | 6/1979 | Grasso | 34/104 |

*Primary Examiner*—Larry I. Schwartz

*Attorney, Agent, or Firm*—David M. Carter

[57] ABSTRACT

There is provided a dryer which is particularly adapted to dry a plurality of fireman's gas masks. The dryer includes a first enclosure having a plurality of air inlet holes through its top, with a second enclosure covering the air inlet holes and being connected to a forced air fan. A plurality of air outlet holes is provided in the bottom of the first enclosure. Tubes from the gas masks are connected to certain of the air inlet holes whereby the forced air passes onto the inside surfaces of the mask. The other air inlet holes provide forced air for drying the outside surfaces of the masks.

3 Claims, 4 Drawing Figures

DRYER FOR GAS MASKS AND THE LIKE

BACKGROUND OF THE INVENTION

This invention relates to dryers for devices having wet inside and outside surfaces. More particularly, it relates to dryers for gas masks.

In recent years, it has been more and more prevalent for firemen to utilize gas masks while fighting a fire, or in any situation where there is smoke present, particularly when it is necessary for a fireman to enter a smoke filled building. The mask includes a covering for the face and a hose which is adapted to be connected to a portable air tank. After use, it is necessary to wash the mask to remove the particulate matter and odors therefrom. The washing wets the inside and outside surfaces of the mask.

A longstanding problem which occurs after washing is the inability to easily dry the masks, particularly the inside surfaces of the masks. In the past, firemen have dryed masks, one at a time, by using a portable hair dryer for both the outside and the inside surfaces. For the inside surfaces, the air output portion of the hair dryer is placed near the opening of the mask hose. The diameter of the air output portion of a hair dryer is larger than the diameter of the hose; therefore, it cannot be inserted. Thus, much of the air is wasted. Obviously, this is a very time-consuming, inefficient and labor-intensive procedure.

In a non-analogous art, U.S. Pat. No. 4,158,262, issued to Grasso, shows a cabinet for drying one or two radiators, whereby a compartment housing a dryer fan and piping is adjacent a side wall of the housing for the radiators. Obviously, the Grasso dryer would not work well for drying gas masks.

OBJECTS OF THE INVENTION

It is therefore one object of this invention to provide a simple and inexpensive apparatus for drying a plurality of devices having wet inner and outer surfaces.

It is another object to provide an apparatus for simultaneously drying the inside and outside surfaces of a plurality of gas masks.

It is still another object to provide an apparatus which both acts as a dryer and storage container for gas masks.

SUMMARY OF THE INVENTION

In accordance with one form of this invention, there is provided a dryer for a plurality of devices which have both inner and outer surfaces which are wet. The dryer includes an enclosure having at least top and side walls. A plurality of air inlet holes are received in the top wall. A plurality of air outlet holes are also received in one of the walls. A source of forced air is connected to the air inlet holes. At least some of the air inlet holes are connected to the wet devices for forcing air onto the inner surfaces of the wet devices. The other air inlet holes force air onto the outer surfaces of the devices.

More specifically, there is provided a dryer for a plurality of gas masks and the like, with the dryer also being utilized to store the mask. A first enclosure houses the masks, and has top and side walls. At least one of the walls has a plurality of air inlet holes therein. A second enclosure covers the air inlet holes. An air movement means is connected to the second enclosure for forcing air into the second enclosure. A mechanism is provided for attaching the gas mask to at least some of the air inlet holes wherein air moves into the interior of the gas masks.

BRIEF DESCRIPTION OF THE DRAWINGS

In the detailed description as follows, reference will be made to the following drawings, comprising the following figures.

DESCRIPTION OF THE PREFERRED EMBODIMENT

Figure 1:
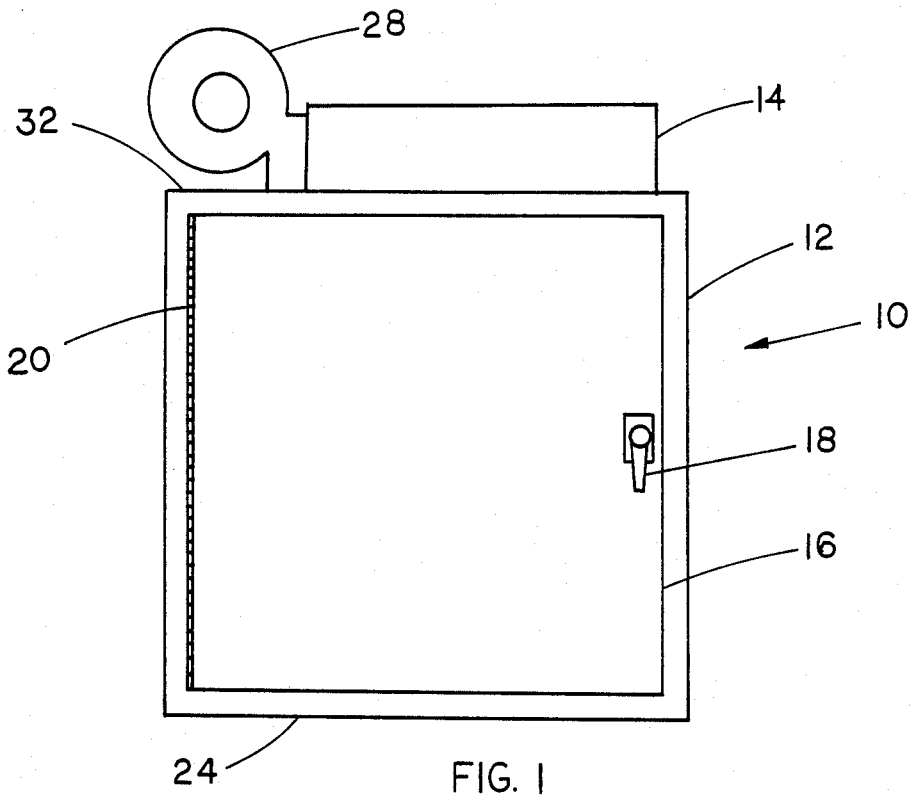
FIG. 1 is a front elevational view of the dryer of the subject invention.

Referring now more particularly to FIG. 1, there is provided dryer 10 having first enclosure 12 and second enclosure 14 attached thereto. First enclosure 12 includes a door 16 with handle 18 and elongated hinge 20. The bottom 24 of the first enclosure is held up from the ground when the dryer is mounted to a wall, as will be explained below. Forced air electrical fan 28 is connected to one side of second enclosure 14.

Figure 2:
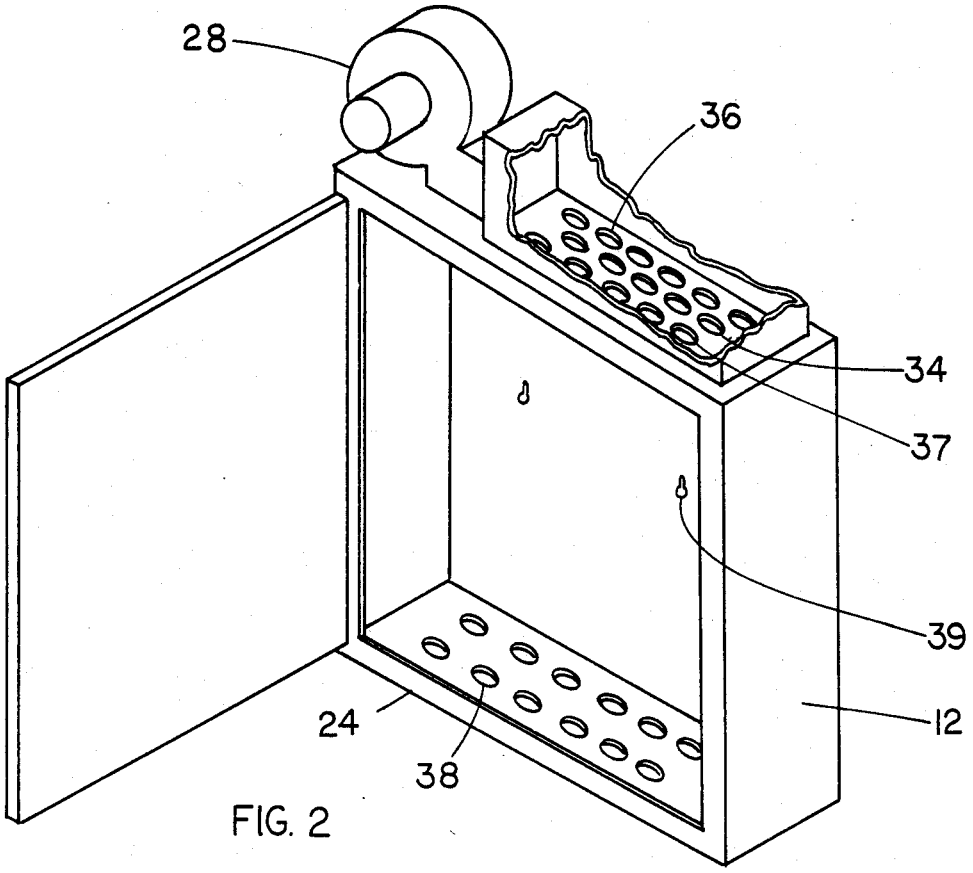
FIG. 2 is a perspective view of the dryer of FIG. 1 with portions removed.

Referring now more particularly to FIG. 2, top wall 32 has a plurality of holes therethrough. The holes in row 34 are threaded, the function of which will be explained later. The holes in rows 36 and 37 are unthreaded. Referring again to FIG. 2, the holes 34 are in a row flanked by a row of holes 36 and 37 on either side. All of the holes in the top of the first enclosure 12 are referred to as air inlet holes. The bottom 24 of first enclosure 12 includes two rows of air outlet holes 38. The dryer is attached to a wall by applying screws (not shown) through holes 39 in back wall 41 of the first enclosure.

Figure 3:
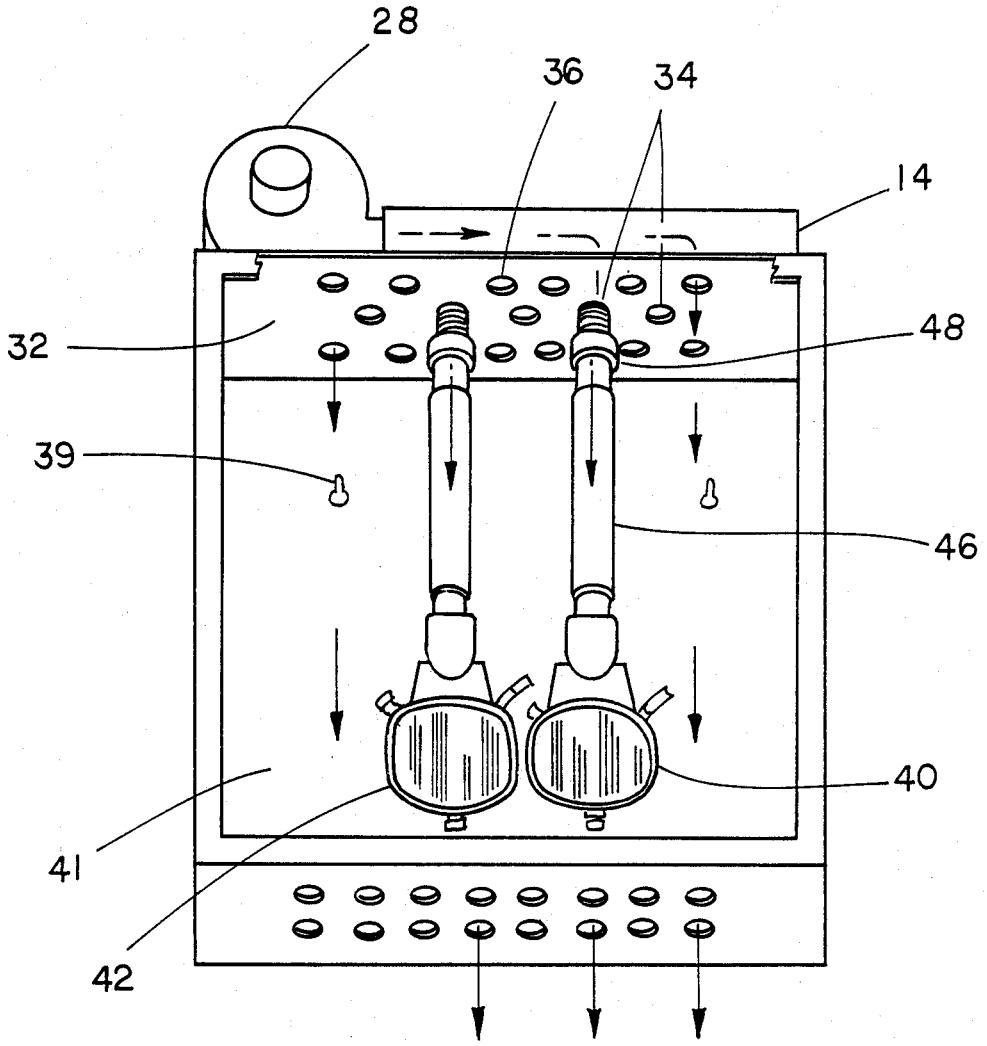
FIG. 3 is another perspective view of the dryer of FIG. 1 showing the devices to be dryed and the air flow.

Referring now to FIG. 3, a plurality of gas masks are received in the first enclosure. In the exemplification embodiment, for simplicity, only two masks 40 and 42 are shown connected to the larger holes 34 in the top 32 of the first enclosure. Each gas mask includes a hose 46 which is threaded on its end. The threaded end of the hose 46 of each mask is connected to holes 34 by means of coupling 48 which may be better seen in reference to FIG. 4.

Figure 4:
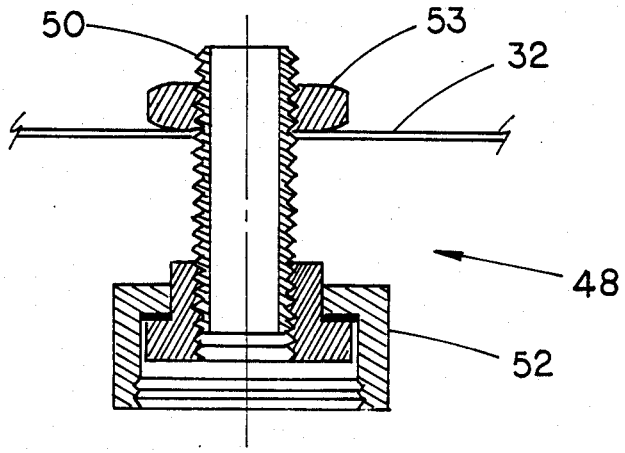
FIG. 4 is a cross-sectional view of the specialized connector used to connect the devices to be dryed to the dryer of FIG. 1.

As can be seen from FIG. 4, the coupling 48 includes hollow threaded stud 50 and ring 52 and nut 53 attached thereto. Nut 53 holds the coupling 48 to the top 32 of the enclosure. The coupling is adapted to receive the threaded portion (not shown) of the tubes of each gas mask.

The drying apparatus described above operates as follows: After the gas masks are washed, moisture remains both on the outside surfaces and the inside surfaces of the masks. A plurality of the masks are placed inside the first enclosure by attaching the hoses of the mask to the larger holes 34 of top 32 by coupling 48. Thus, the masks hang as shown in the position shown in FIG. 3. When the masks are hanging, some of the moisture which is on the inner and outer surfaces of the masks will drip to the bottom of the enclosure and out the holes 38.

Forced air fan 28 is turned on, and air flows into a second enclosure 14, through the larger holes 34 in the top of the first enclosure through the inside of the hose 46 of each mask, through the face portion of the mask, and out the bottom portion of the mask. Air also flows from the second enclosure 14 through rows of holes 36 and 37 in the top 32 of the first enclosure, thus into the first enclosure and on and around the outer surfaces of masks 40. The air contacting the outer surfaces and the inner surfaces of the mask exit the first enclosure through holes 38 in the bottom of the first enclosure. After the masks are dried, the fan 28 is shut down, and the masks may be left inside the enclosure for convenient storage. The fan may be equipped with a timer (not shown) so that it will automatically turn off.

Thus, there is provided an efficient and inexpensive apparatus for drying gas masks and the like which also acts as a storage container, and which may simultaneously dry a large number of masks.

I claim:

1. A dryer for gas masks and the like comprising:

a first enclosure for housing the masks; said first enclosure having at least top and side walls; at least one of said walls having a plurality of air inlet holes therein;

a second enclosure covering said air inlet holes; air movement connected to said second enclosure for forcing air into said second enclosure;

a first group of air inlet holes;

a plurality of attachment means for connecting the gas masks to each hole in said first group of said air inlet holes whereby air moves into the interior of the gas masks;

a second group of air inlet holes; at least one air inlet hole from said second group being adjacent to each air inlet hole of said first group;

said second group of air inlet holes not being adapted to be connected to gas masks whereby air passes over the exterior of the gas masks at the same time that air moves into the interior of the gas masks; said plurality of attachment means are connectors interfacing between said first group of air inlet holes and said masks; each connector includes a threaded stud and a threaded coupling ring connected to said stud; each of said masks including a threaded portion; said studs being connected to said threaded portion of said masks by said threaded coupling ring providing an airtight connection; said dryer further including a bottom wall and a plurality of air outlet holes in one of said walls of said first enclosure, whereby air and moisture passes from the inside of said first enclosure to the outside.

2. A dryer as set forth in claim 1 wherein said air inlet holes are arranged in parallel rows; said second group of air inlet holes including a pair of rows being on both sides of a row including said first group of air inlet holes.

3. A dryer as set forth in claim 1, wherein said air inlet holes are on said top wall of said first enclosure, and said second enclosure is mounted to said top wall of said first enclosure.

* * * * *